US007237273B2

(12) United States Patent
Hernández

(10) Patent No.: US 7,237,273 B2
(45) Date of Patent: Jul. 3, 2007

(54) DOUBLE FACE WORK GLOVES

(75) Inventor: Jose Lorenzo Urbina Hernández, Col. Asturias (MX)

(73) Assignee: Adeti Seguridad Industrial, S.A. DE C.V. (MX)

( * ) Notice: Subject to any disclaimer, the term of this patent is extended or adjusted under 35 U.S.C. 154(b) by 0 days.

(21) Appl. No.: 11/240,008

(22) Filed: Sep. 30, 2005

(65) Prior Publication Data

US 2006/0064796 A1 Mar. 30, 2006

(30) Foreign Application Priority Data

Sep. 30, 2004 (MX) ..... PA/u/2004/000219

(51) Int. Cl.
*A41D 19/00* (2006.01)

(52) U.S. Cl. ..... 2/161.6; 2/159; 2/160; 2/161.1; 2/161.7; 2/163; 2/162

(58) Field of Classification Search ..... 2/160, 2/159, 161.1, 161.7
See application file for complete search history.

(56) References Cited

U.S. PATENT DOCUMENTS

| | | | | |
|---|---|---|---|---|
| 1,235,010 | A | 7/1917 | Charney | |
| 1,375,904 | A * | 4/1921 | Gillian | 2/169 |
| 1,791,581 | A * | 2/1931 | Stokes | 2/162 |
| 2,148,849 | A * | 2/1939 | Blewer | 2/159 |
| 2,150,018 | A * | 3/1939 | Bates | 2/159 |
| 2,216,242 | A * | 10/1940 | Kirchner, Jr. et al. | 2/159 |
| 3,484,869 | A | 12/1969 | Cullinan | |
| 4,001,895 | A * | 1/1977 | Cohen | 2/161.6 |
| 4,247,249 | A | 1/1981 | Siemers | |
| 4,654,895 | A * | 4/1987 | Peters | 2/161.1 |
| 4,847,918 | A | 7/1989 | Sturm | |
| 4,850,053 | A | 7/1989 | Tepley et al. | |
| 5,499,400 | A | 3/1996 | Masuda et al. | |
| 5,511,248 | A | 4/1996 | Widdemer | |
| 5,829,061 | A | 11/1998 | Visgil et al. | |
| 6,233,742 | B1 * | 5/2001 | Yungkurth | 2/160 |
| 6,732,378 | B2 * | 5/2004 | Novak | 2/161.6 |
| 6,895,599 | B1 * | 5/2005 | Templer | 2/160 |
| 2003/0233695 | A1 * | 12/2003 | Golde | 2/161.1 |

* cited by examiner

*Primary Examiner*—Gary L. Welch
*Assistant Examiner*—Alissa Tompkins
(74) *Attorney, Agent, or Firm*—Brooks Kushman P.C.

(57) ABSTRACT

Improved work gloves comprising a front face forming a human hand which may define four to five fingers, a rear face forming a human hand defining four to five fingers, wherein the rear face is identical to the front face, a tuck strip joining said front face to said rear face, a fist joined to said front face, to said rear face and to said tuck strip, an elastic band running through both faces, wherein said work faces may be used in both hands at distinct times. Said fist may be detachable as well as the glove thumb. The materials of the glove may comprise animal, vegetal or synthetic fabrics as long as said material is resistant.

9 Claims, 8 Drawing Sheets

DOUBLE FACE WORK GLOVES

FIELD OF THE INVENTION

The invention refers to the field of gloves. More particularly this invention is directed to a double face work glove, which provides protection against heat, cold and abrasion.

BACKGROUND OF THE INVENTION

Gloves have been used all along history to keep warm hands warm in cold weathers and to protect hands from work abrasions. When the material of the glove is thicker, the glove provides a better protection against cold and abrasions. Human hands, nevertheless, move in complicated manners and to identify and control objects, relying on the sensitive touch of our fingers and hands. Ambient evidences normally detected disappear upon using gloves. This problem increases when the glove's material is thicker.

It is obvious that the glove's material is determined upon the final use the glove will undergo. Leather gloves are widely used in any kind of operation with heavy machinery.

The more use the glove undergoes, the more damage the glove shall have and hence hands become more sensitive to the atmosphere since they have more contact with such atmosphere. Gloves are manufactured from all known materials, animal skins and leathers, synthetic fabrics as well as the combination thereof, in order to provide heat to hands and protect hands against abrasions. Notwithstanding the above, no glove using known materials has been able to provide a durability level without damage, allowing the dexterity and sensitive level allowed by the glove of the present invention.

U.S. Pat. No. 4,847,918 refers to gloves protecting hands from heat. The gloves have a plastic reinforcement member longer than the glove's fingers, said reinforcement member is attached to one of the plastic glove faces providing a security label. These security labels are sewed inside the finger tips. The glove may be turned when the internal portions are pulled towards the exterior cavity and hence the plastic glove and the reinforcement member come out. One of the disadvantages of this glove is the amount of materials the glove is manufactured from. That is, the rupture of the glove is easier when using more materials, since more friction between each of the materials shall occur. Additionally, the damage made to the glove accelerates with the rupture of the first layer of said glove.

Another patent intends solving the glove damage problem is U.S. Pat. No. 4,247,249, which discloses a heavy work glove which preferably has a palm leather and leather finger tips. The surface of this regions is covered with leather portions having certain thick, configuration and means so as not to affect the flexibility of the glove, providing a glove having a good grasp and less subject to damage. Again, the invention of this patent protects the user's hand upon using several layers and reinforcement at the user's hand face. Therefore, this invention faces the above-mentioned problem, i.e., a rapid and easy rupture after the first layer rupture.

However, there are few inventions referring to resistant gloves, e.g. the gloves disclosed in U.S. Pat. No. 4,850,053 have high flexibility, and due to their structure, these gloves have the purpose of providing a glove manufactured to fit a working hand, however due to their structure, this glove tends to damage quickly.

An example of for a glove having more durability is disclosed in U.S. Pat. No. 5,829,061, which provides hand and finger protection against cold and abrasions. The hand portion is made from foam material having a width of between 1 mm and 5 mm. A hand cavity is disposed at the hand portion defined by the foam material. The finger portions are mounted at the hand portion periphery and extend outwards. The finger portion has a front face and a rear face and tip located at the distal portion from the hand portion. The finger portions are made from foam material and have between 1 mm and 5 mm. The cavities of the fingers are located on the portions of the fingers and defined by the foam material strip. The foam material is an elastic, non absorbing and isolating material.

However, event with the foam, said glove does not achieve good performance when used during a long time combined in hard works.

Most of the documents referring to gloves, reveal a flexibility and/or grasping improvement thereof. For example, U.S. Pat. No. 5,499,400 discloses working gloves having better flexibility due to the restriction in the covering infiltration grade, producing a thin coating when the exterior surface of the glove is coated with chloride vinyl resin, rubber or similar, and subject to anti-microbial or deodorizing treatment, with the manufacturing technique described in the patent. Said patent, it is a good example for working gloves. However, the object of the invention is that the user obtains a good grasp in the specimen he is working with, and not glove durability.

Another example is U.S. Pat. No. 5,511,248, which refers to an improved design for an anti-sliding glove. The surface of such glove is adapted to provide a specially strong joint between the face and/or the fingers and the object to be grasped by the user. Once again, this patent is directed such that the user is able to have a good grasping when using the glove, not glove durability.

Hence, this invention has as an object providing a work glove with a better durability compared with prior art gloves.

Another object of the present invention is providing a work glove with better grasp than those in prior art, combined with a higher durability.

Yet another object of this invention is providing a work glove which may be used in several ways, thus versatile.

An additional object of the present invention is providing a work glove that due to its versatility, it may be used at anyone of the user's hands.

Yet, another object of this invention is providing a work glove from few parts in order to have higher durability.

Additionally another object of this invention is providing a glove protecting the user from cold, heat and abrasion without missing contact with the machinery the user is working with, i.e., a work glove lighter but more resistant.

Another object of the invention is providing a work glove which is not expensive when manufactured.

As any other marketable object, the work glove of this invention has as a purpose to offer a better comfort to the user, as well as a higher durability.

Other objects and advantages of this invention shall be obvious and apparent by the following specification.

BRIEF DESCRIPTION OF THE FIGURES

In order to have a better understanding of the invention, the following is a description of the invention alongside the following figures, where.

DETAILED SPECIFICATION OF THE INVENTION

Figure 1:
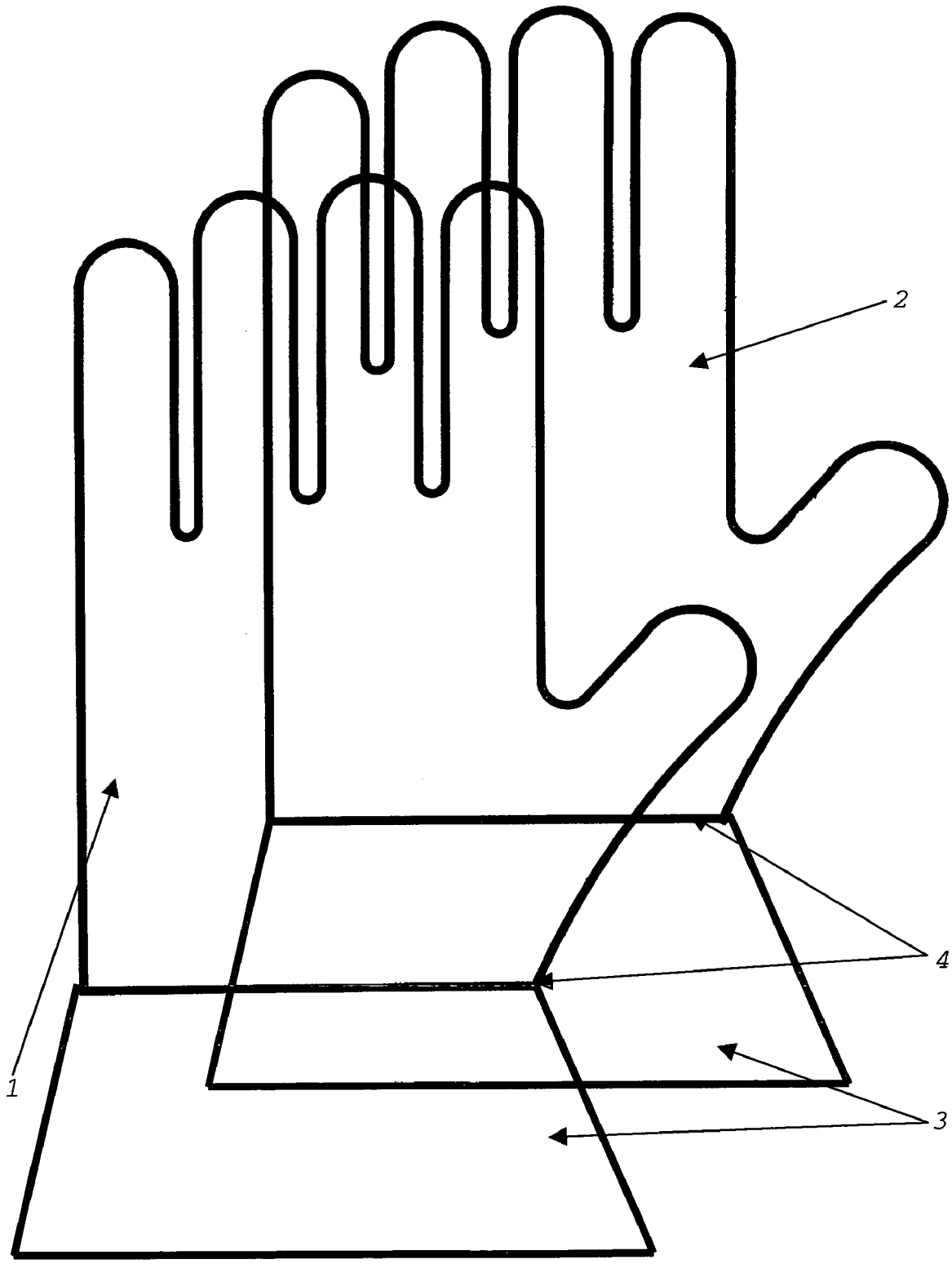
FIG. 1 is a front view of the two main parts of the work glove of the present invention.

In FIG. 1 the two main components of the present invention are shown. FIG. 1 shows the front face (1) of the work glove and the rear face (2) of said glove. The above shows that the front and rear faces sides are the same.

As any other glove, this glove comprises space for all the hand fingers, i.e., it includes space for the thumb, index, medium, annular and little finger.

Said front face (1) and rear face (2) may vary in thickness. The glove thickness depends on the determined use by the user. The thickness of these gloves may vary between 0.01 mm (0.000394 inches) to 2 cm (0.787 inches) thickness.

Figure 2:
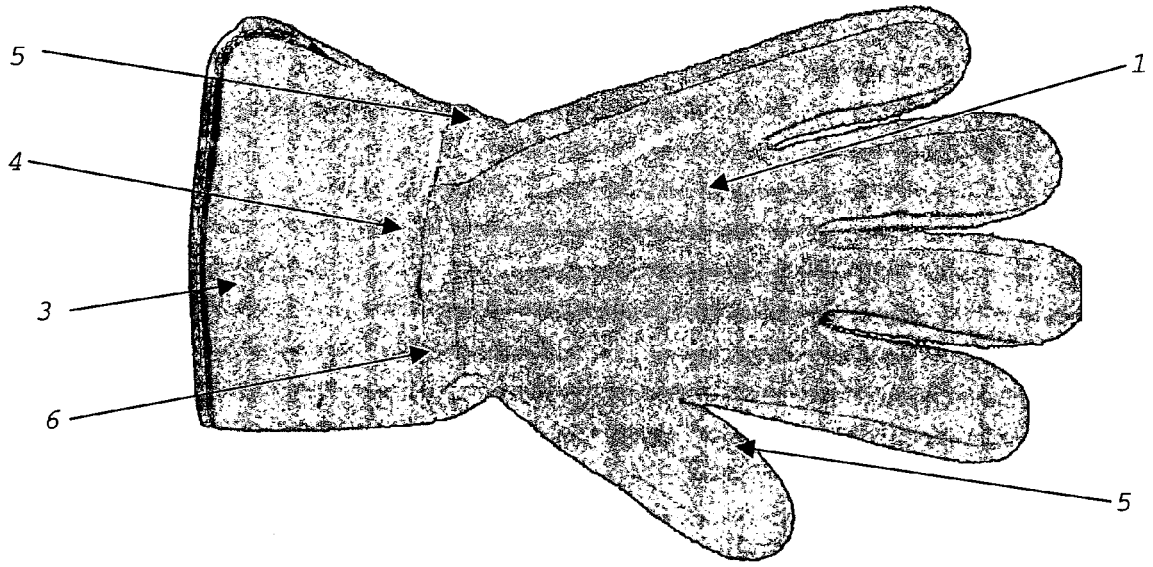
FIG. 2 is a front view of the work glove of the present invention.

In FIG. 2, the front face (1) of the work glove may be observed. As it may be observed, the material of said front face (1) is preferably leather, although the glove can be made from different materials, such as curly fabric, rubber, etc., wherein it may be any animal, vegetal o synthetic material, as long as said material is resistant.

Figure 3:
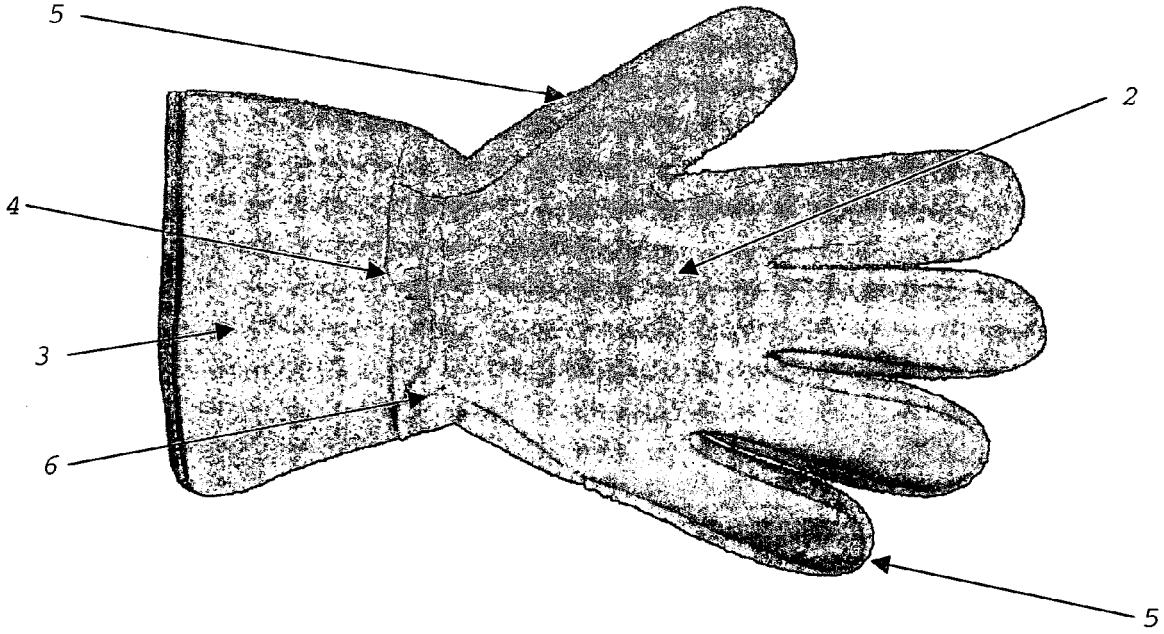
FIG. 3 is a rear view of the work glove of the present invention.

In FIG. 3, the work glove in said rear face can be observed. The material of said rear face (2) may be the same or different from said front face (1).

Figure 5:
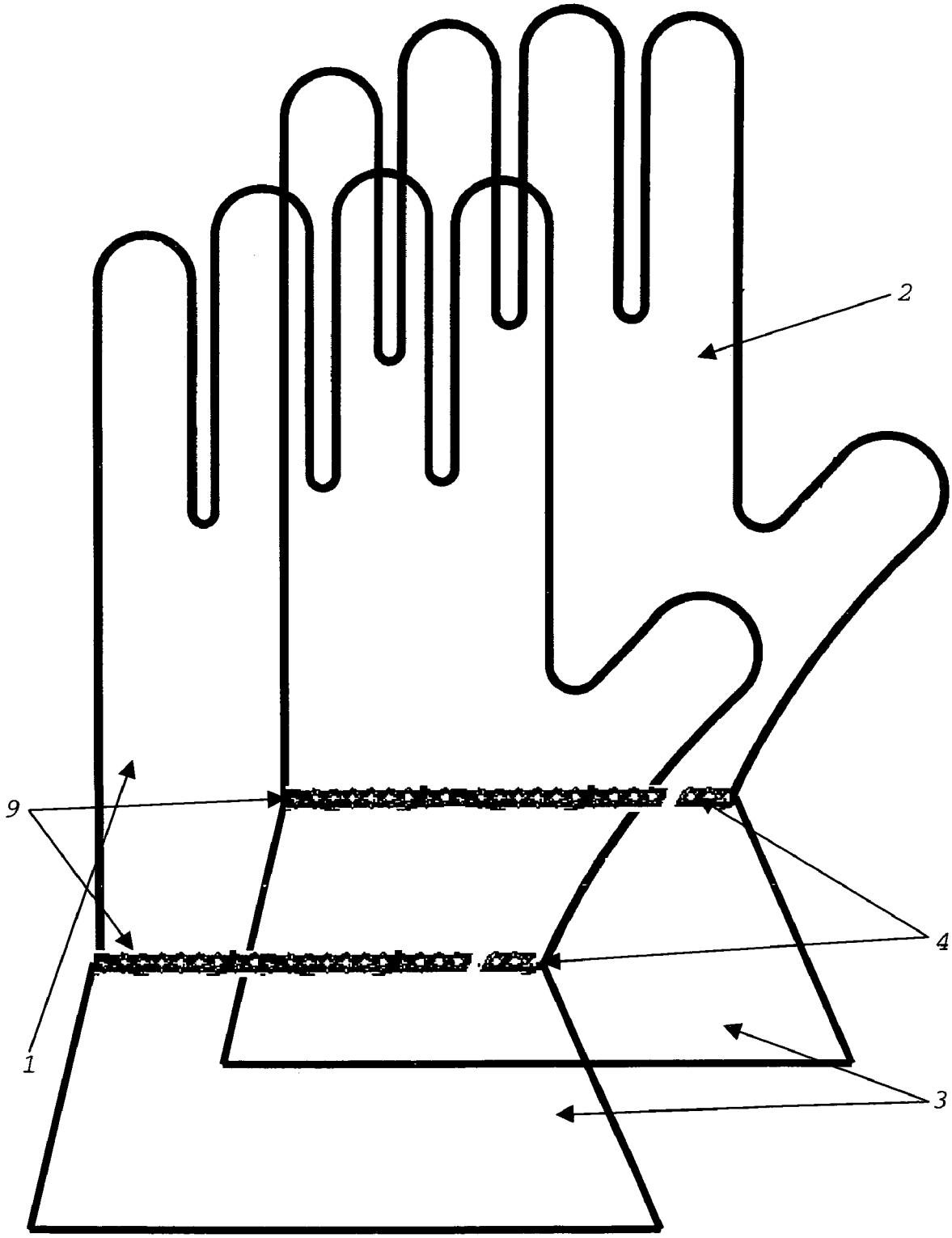
FIG. 5 is a front view of the two main parts of a second embodiment of the work glove of the present invention.

Said glove may include a fist (3) for more protection of the user. Said fist (3) may be sewed with said front face and sewed with said rear face (2). The joint (4) between said fist (3) and said front face (1) may be observed in FIG. 2. In one of the preferred embodiments of the glove, said fist (3) is a portion of said front face (1) and said rear face (2) That is, there is no separation between said fist (3), said rear face (2) and said front face (1). In another preferred embodiment, said fist (3) is joined to the front face (1) and said rear face (2) by means of a first zipper (9), as may be observed in FIG. 5. Said first zipper (9) makes said fist (3) totally detachable from said front face (1) and said rear face (2). The above provides an advantage to said work glove since, depending on the work nature, the fist (3) may obstruct.

The truncated cone form of fist (3) provides one advantage to said glove. The above may be sensed when the user works with heavy machinery, said fist (3) protects the user's sleeve against any abrasion the user may have, thanks to the length of said fist (3) and the configuration thereof. In the same way, said fist (3) protects the user's sleeve from the machinery heat as well as from cold.

The elastic band (6) observed in FIGS. 2 and 3 helps avoid the sliding of the glove from the user's hand. Even if in the preferred embodiment said elastic band (6) is in the internal portion of said front face (1) and said rear face (2), in these figures it is shown with the elastic band externally for demonstration purposes. As it may be observed from any of the above mentioned figures, said band (6) must be approximately from 0.5 cm (0.197 inches) to 5 cm (1.97 inches) of distance from said fist (3) in order to provide more comfort to the user. In the same manner, it may be observed in the above figures that said band (6) has the same length than said front face (1) or said rear face (2), even though in one of the preferred embodiments, said band (6) it may surround the lower end of the glove of this invention.

Said band (6) is preferably made from an elastic material, without limiting the material the glove may be made from. Likewise, said band may have any kind of configuration, such as rectangular, as said work glove could be in its lower end in the embodiment without band (6) or it also may be crossed, i.e., in zigzag.

In FIG. 2, the tuck strip (5) of the work glove may also be observed. Said tuck strip (5) may be made from the same material as said rear face (2) or said front face (1), even though other materials are not discarded. For example, in one of the preferred embodiments, said tuck strip (5) may be from an elastic material such as lycra. Said tuck strip (5) may be made from more than one portion up to five. The more portions this tuck strip (5) is made from, the easier it is to assemble the glove. For example, said tuck strip (5) may be made from one or more strips. Nevertheless, in one of the preferred embodiments, said tuck strip (5) is made from only one piece. Said tuck strip (5) joins from the internal portion said front face (1) and said rear face (2).

Said tuck strip (5) may vary in width should it be made from an abrasion, fire or cold non-protecting material. The above, allows the work glove to be used in different hand sizes.

Additionally, said tuck strip (5) may be eliminated from the work glove. In one of the preferred embodiments of the invention, said front face (1) of the work glove is joined directly to said rear face (2) either by threads or glue, depending on the material used in the work glove.

Figure 8:
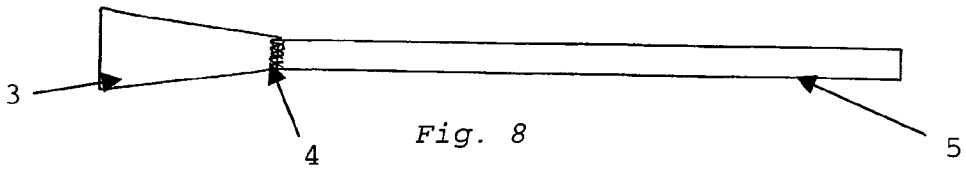
FIG. 8 is a left side view of the work glove of the present invention.
Figure 9:
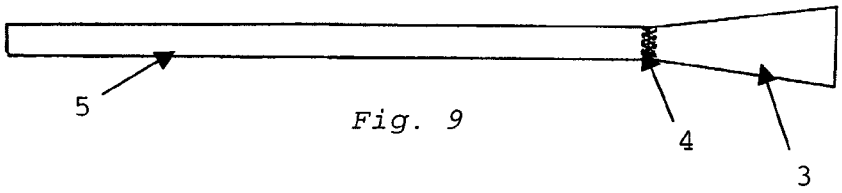
FIG. 9 is a right side view of the work glove of the present invention.

FIGS. 8 and 9 show in a better way the tuck strip (5) used for the present invention. Also in these figures show said joint (4) between said fist (3), said front face (1) and said rear face of the glove.

The varieties of tuck strips (5), as described above, are an advantage since the lesser joints and layers the work gloves contains, the lesser damage the gloves will undergo due to the lack of joints existing in the gloves. Hence, the work glove of this invention may be made from two to eight portions as it will discussed below.

The glove of this invention may be made from two main portions, wherein these two main portions would necessarily be said front face (1) and said rear face (2). Other portions described along this specification are fist (3), tuck strip (5), band (6) and a zipper in one of the embodiments of the invention.

Figure 4:
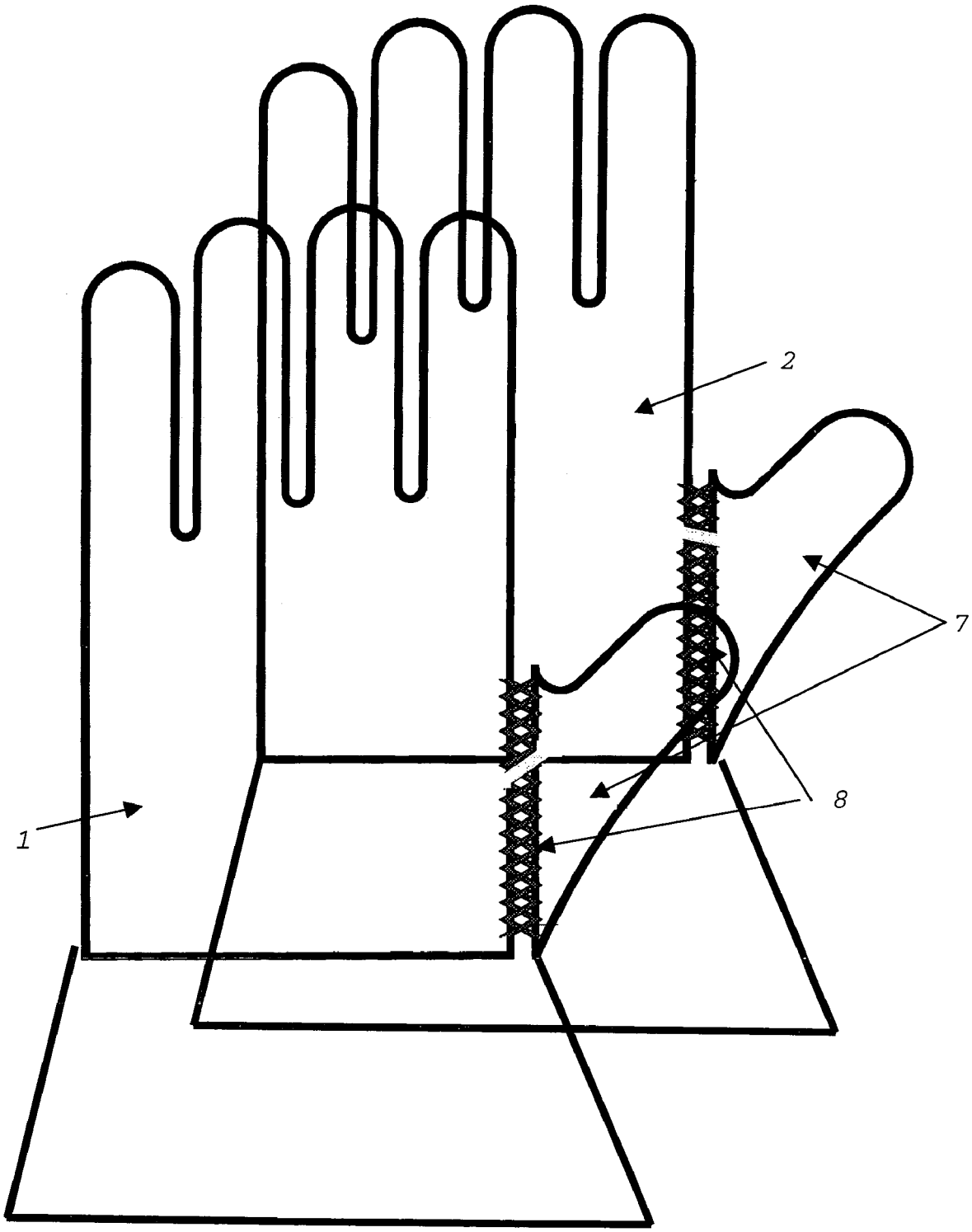
FIG. 4 is the front view of the two main parts of a first embodiment of the work glove of the present invention.

One of the preferred embodiments of this invention may be observed in FIG. 4. FIG. 4 shows the same work glove with a second zipper (8) running from the initial portion of thumb (7) of the glove to a final portion of the thumb (7) in the glove. The above for said thumb glove portion to be detachable, as described above with the fist (3). Thus a sixth and seventh portion of the glove are formed, i.e., a detachable thumb (7) and a second zipper (8).

Figure 10:
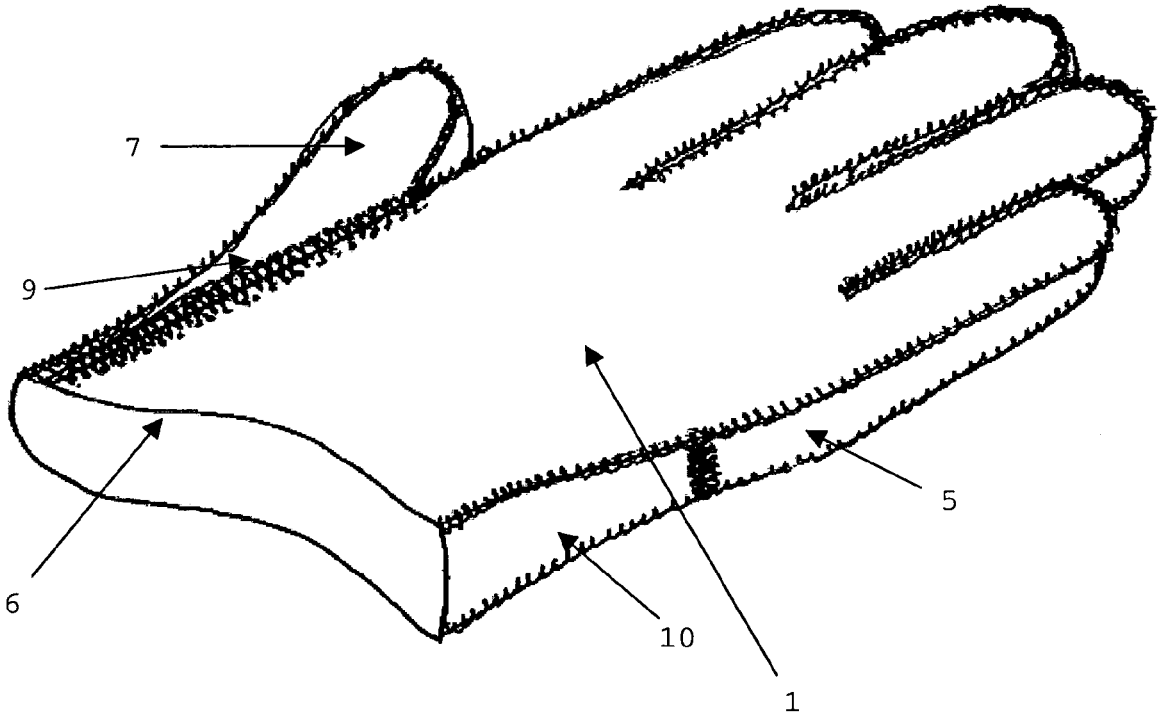
FIG. 10 is a conventional perspective view of the first embodiment of the present invention work glove, wherein said embodiment does not contain a fist.

FIG. 10 shows an embodiment of the second embodiment of the invention. The tuck strip (5) has been shortened in size, thus said tuck strip (5) reaches up to the initial portion of little finger. In the portion corresponding to the face, there is a side tuck (10). The above provides the advantage of having a hand higher mobility.

One of the notable advantages this work glove provides, observed in FIGS. 2 and 3, is that both sides, said front face (1) and said rear face (2), are identical. In this sense, the glove may be used in both hands, solving hence the rapid damage problem of working gloves. To change the glove from one hand to the other, the glove has to be turned 180 degrees and use the glove in the other hand. When one side is damaged, the user has but to turn the work glove and use the glove in the other hand.

Figure 6:
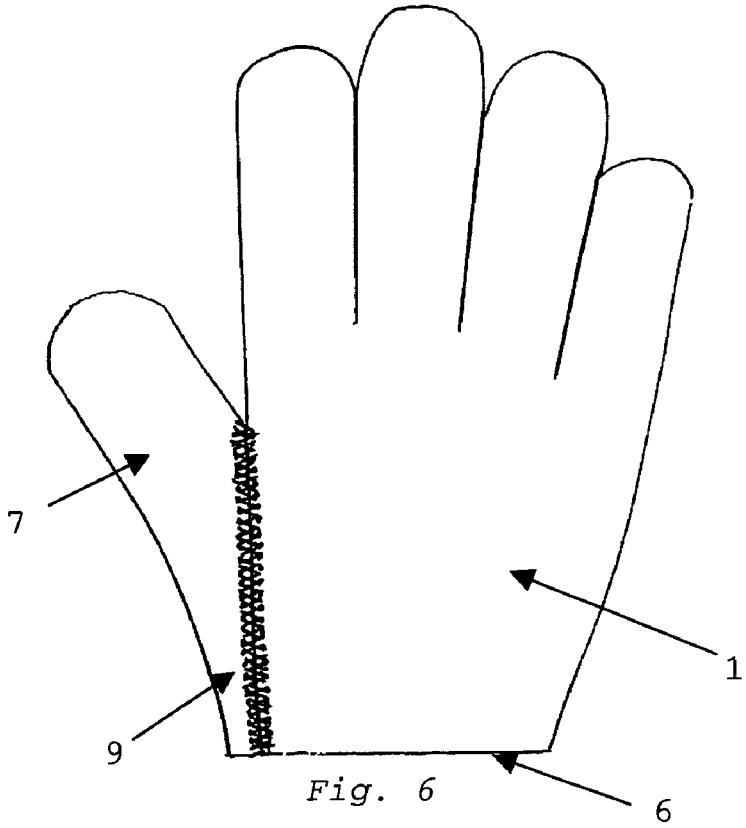
FIG. 6 is a front view of the first embodiment of the present invention work glove, wherein said embodiment does not contain a fist.
Figure 7:
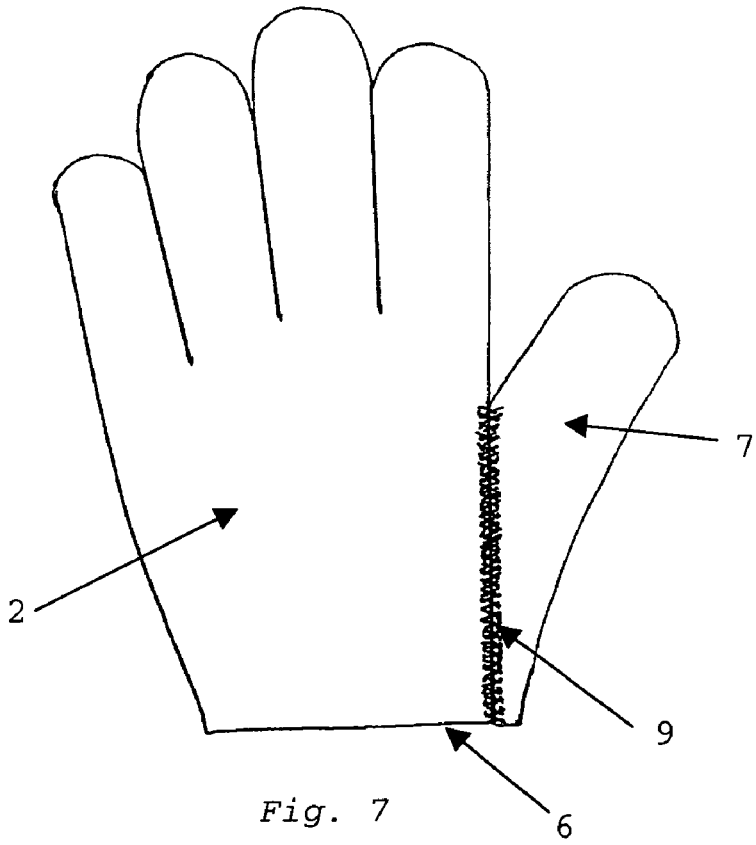
FIG. 7 is a rear view of the first embodiment of the present invention work glove, wherein said embodiment does not contain a fist.

FIGS. 6 and 7 respectively shows the front face (1) and rear face (2) of said glove. These two figures are according to the above mentioned second embodiment. The difference between these figures, when compared to FIG. 4, is that this embodiment does not contain a fist (3) thus the elastic band (6) is located at the lower end portion of the glove.

Another embodiment of the glove is that it may include a second reinforcement in both faces. That is, to provide a better cold, heat and abrasion protection for the user, the glove contains a second material for reinforcement in both said front face (1) and said rear face (2). The material, as discussed above, is not a limitation in this invention. As mentioned above, the glove may be made from more than one material. For example, while tuck strip (5) may be made from expansible textiles, said front face (1) and said rear face (2) may be made from another material.

In another preferred embodiments of the invention, said front face (1) may be made from a different material than the material of said rear face (2) of the glove. This provides said work glove an advantage. Depending on the work roughness, the work glove user may use the side more appropriate to the type of work. Likewise, in another embodiment of the invention, the finger tips can be made from a touching sensitive material, such as a thin material.

In the same way, in another preferred embodiment of the invention, is that in said front face (1) materials for better grasp may be found, as well as in said rear face (2). The above so that said work glove is adapted to provide a specially strong joint between the face and the object to be grasped by the user or between the fingers and the object to be grasped by the user.

Figure 11:
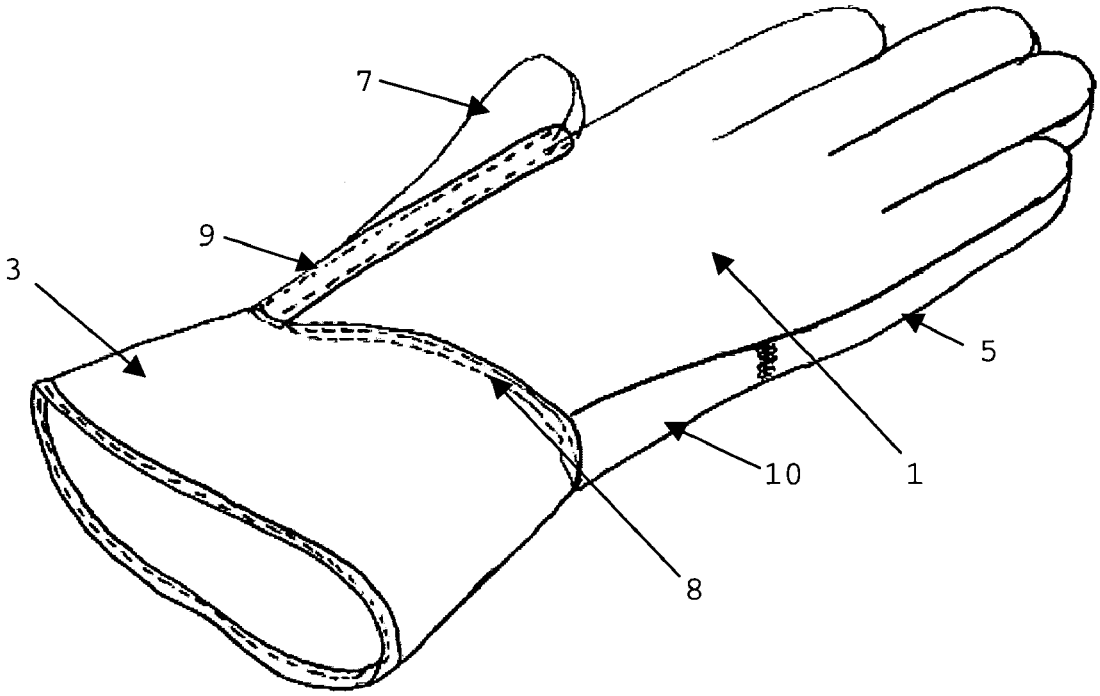
FIG. 11 is a perspective view of a third embodiment of the present invention work glove.
Figure 12:
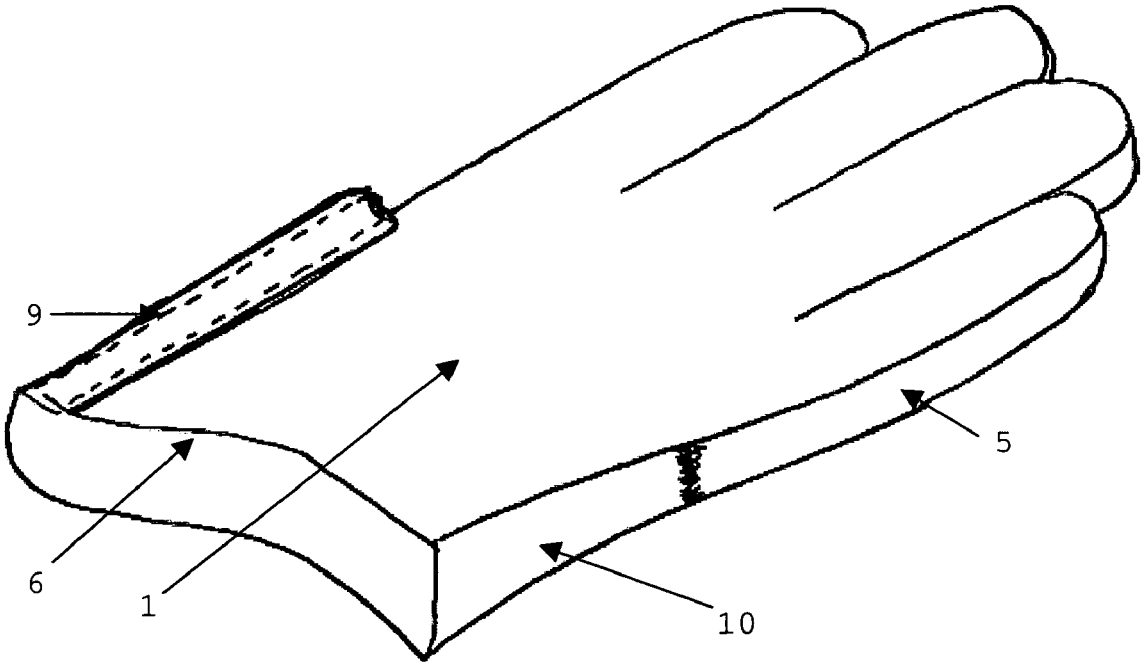
FIG. 12 is a perspective view of the result of the third embodiment of the present invention work glove.

FIGS. 11 and 12 show a third preferred embodiment of the invention. In these figures the second zipper (8) is combined with the first zipper (9) as it may be observed in FIG. 11. FIG. 12 is the result of the thumb (7) and fist (3) detachment, wherein said detachment can be achieved through the two zippers.

Figure 13:
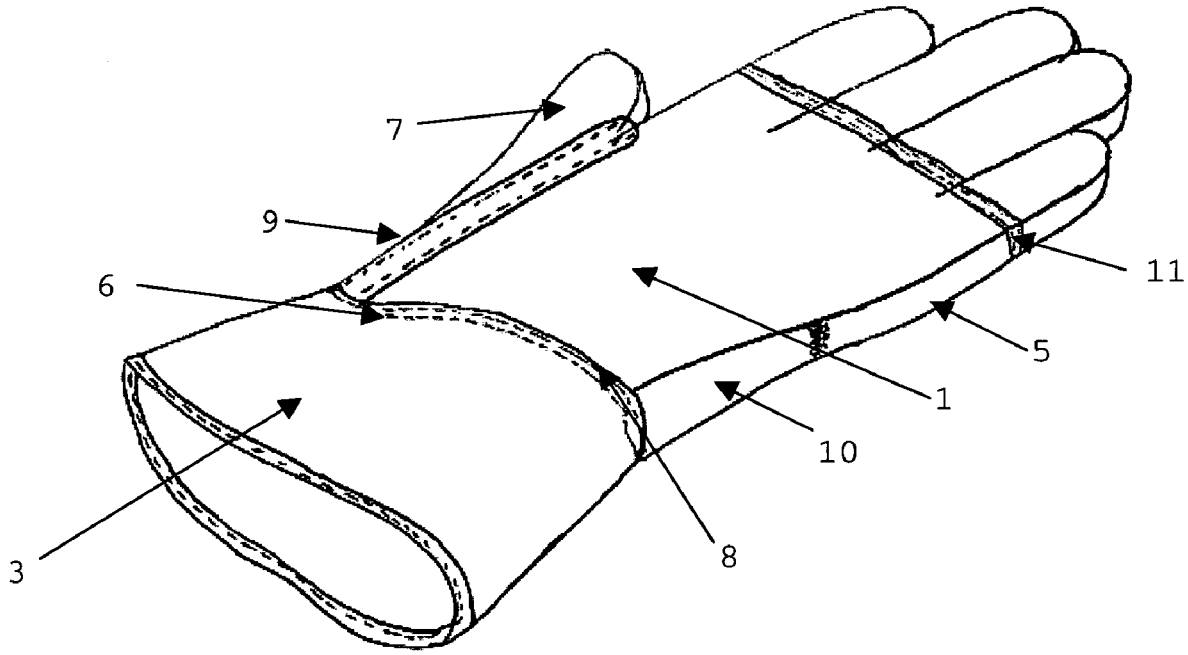
FIG. 13 is a perspective view of a fourth embodiment of the present invention work glove.

Finally, FIG. 13 is a fourth preferred embodiment of the present invention. FIG. 13 is a combination of the third embodiment with a third zipper (11), where said third zipper (11) allows the detachment option of the protection of all fingers, except thumb (7), since the protection of said thumb (7) is detached by second zipper (8). The advantage of detaching all fingers is that a touch sense is provided without vibration in the hand face, so the grasping remains the same as having the complete glove. That is, a padding in the interior of the glove may be found so vibration does not affect the grasping that the hand may have.

Another of the advantages provided in the detachable portions of the gloves of the present invention, is that the detachable portions can be made from materials different than said front face (1) and said rear face (2) of the glove.

Joining styles between the glove portions, so they can remain joined, may be from the group including interior sewing, exterior sewing, exterior chain sewing, interior chain sewing, meshing, hand made exterior glove sewing, hand made interior glove sewing, zigzag sewing, glued, among other joining styles.

While the invention has been disclosed in regard to the preferred and more practical embodiments, it also must also be understood that the invention is not limited to the embodiments described herein but it is pretended to cover a variety of modifications and equivalent arrangements included within the spirit of the claims in order to all the modifications and equivalent structures permitted by law be involved.

The invention claimed is:

1. A pair of work gloves, each glove comprising:

a front face defining a palm section of the hand and five sections for fingers;

a rear face defining a palm section of the hand and five sections for fingers;

a tuck strip, wherein the front face, the rear face and the tuck strip define lodging for the palm section of the hand and five lodging portions for each of the fingers; and a lower access opening to the glove, an elastic band running through said two faces, disposed near the access opening, wherein the rear face is substantially identical to the front face, said tuck strip joins the periphery of said front face with said back face so that a user may alternatively put the gloves on with front face overlying the user's palm or switch the gloves between hands and have the rear face overlie the user's palms;

wherein the lodging portion of said thumb region contains an annular zipper to completely detach the entire lodging portion of the thumb from the rest of glove.

2. The work gloves according to claim 1, wherein said fist is sewed to said front face, said rear face and said tuck strip.

3. The work gloves according to claim 1, wherein said tuck strip is configured from one to more strips at the same time.

4. The work gloves according to claim 1, wherein the materials of said front face and said rear face are different.

5. The work gloves according to claim 1, wherein the tuck material is the same or different than said rear face and said front face.

6. The work gloves according to claim 1, wherein the tuck material is expansible.

7. The work gloves according to claim 1, wherein the fist material is different than said rear face and said front face.

8. The work gloves according to claim 1, wherein a fist is disposed in the access opening, joined to said rear face, said front face and to said tuck strip.

9. The work gloves according to claim 8, wherein said fist is detachable and joined to said front face, said back face, and said tuck strip by means of a zipper.

* * * * *